US011124934B2

(12) United States Patent
Beason et al.

(10) Patent No.: US 11,124,934 B2
(45) Date of Patent: Sep. 21, 2021

(54) BOLLARD ASSEMBLY WITH STRESS CONTROL DEVICE

(71) Applicant: SCHRAM MANAGEMENT COMPANY, Geneva, IL (US)

(72) Inventors: William Lynn Beason, Iola, TX (US); Michael Scott Brackin, Bryan, TX (US)

(73) Assignee: SCHRAM MANAGEMENT COMPANY, Geneva, IL (US)

( * ) Notice: Subject to any disclaimer, the term of this patent is extended or adjusted under 35 U.S.C. 154(b) by 0 days.

(21) Appl. No.: 16/659,104

(22) Filed: Oct. 21, 2019

(65) Prior Publication Data

US 2020/0378079 A1 Dec. 3, 2020

Related U.S. Application Data

(63) Continuation-in-part of application No. 16/423,410, filed on May 28, 2019, now abandoned.

(51) Int. Cl.

| | |
|---|---|
| ***E01F 15/00*** | (2006.01) |
| ***E01F 13/00*** | (2006.01) |
| ***E02D 27/42*** | (2006.01) |

(52) U.S. Cl.

CPC ..... *E01F 15/00* (2013.01); *E01F 13/00* (2013.01); *E02D 27/42* (2013.01)

(58) Field of Classification Search

CPC ..... E02D 27/42; E04H 12/2292; E01F 15/00; E01F 15/141; E01F 13/00; E01F 15/003; E01F 13/046

See application file for complete search history.

(56) References Cited

U.S. PATENT DOCUMENTS

| | | | | | |
|---|---|---|---|---|---|
| 1,596,657 | A * | 8/1926 | Heber | E04H 12/2292 | 52/168 |
| 2,846,852 | A * | 8/1958 | Cappel | E02D 5/54 | 405/231 |
| 3,342,444 | A * | 9/1967 | Nelson | E04H 12/2215 | 52/165 |
| 3,691,776 | A * | 9/1972 | Hull | E02D 5/54 | 405/232 |
| 4,269,010 | A * | 5/1981 | Glass | E04H 17/08 | 52/154 |
| 4,326,352 | A * | 4/1982 | Barth | E01F 9/623 | 248/156 |
| 4,488,696 | A * | 12/1984 | Sauber | H02G 3/22 | 248/65 |
| 4,515,195 | A * | 5/1985 | Gladstein | B27L 7/00 | 144/195.6 |
| 4,753,411 | A * | 6/1988 | Lechner | E04H 12/2215 | 248/156 |

(Continued)

*Primary Examiner* — Thomas B Will
*Assistant Examiner* — Katherine J Chu
(74) *Attorney, Agent, or Firm* — Marshall, Gerstein & Borun LLP

(57) ABSTRACT

A bollard assembly includes a bollard post, a ground sleeve configured to receive the bollard post, and a stress control device positioned adjacent to the ground sleeve. The stress control device has a face plate and a plurality of support plates secured to a back surface of the face plate. The support plates are angularly space from one another at equal angles and extend radially inward from the back surface towards the ground sleeve such that the ground sleeve fits between the plurality of support plates.

14 Claims, 14 Drawing Sheets

(56) References Cited

U.S. PATENT DOCUMENTS 4,939,877 A * 7/1990 Claffey ..... E02D 5/80 248/156
4,958,807 A * 9/1990 Wylie ..... F16B 7/0446 256/65.03
4,991,367 A * 2/1991 McGinnis ..... E02D 5/226 52/170
5,311,713 A * 5/1994 Goodrich ..... E04H 12/2292 52/301
5,704,188 A * 1/1998 Coulis ..... E04C 3/36 248/156
5,984,587 A * 11/1999 Odle ..... E01F 9/685 248/530
6,240,689 B1 * 6/2001 Haddad ..... E04H 12/2261 248/49
6,289,633 B1 * 9/2001 Lowe ..... E01F 13/046 49/49
6,402,115 B1 * 6/2002 Groff ..... B29C 45/14426 248/156
6,467,756 B1 * 10/2002 Elsasser ..... E04H 12/2215 256/65.14
6,514,006 B1 * 2/2003 Hines ..... B64F 1/20 116/63 C
6,643,982 B1 * 11/2003 Lapp, Jr. ..... E04C 3/36 52/127.2
6,866,251 B2 * 3/2005 Rosaen ..... E04H 17/161 256/25
7,398,961 B2 * 7/2008 Froese ..... E04H 12/2253 256/65.14
7,627,994 B1 * 12/2009 Demirkan ..... E04H 12/2269 248/530
7,942,612 B1 * 5/2011 Willison ..... E02D 5/74 405/244
8,011,149 B2 * 9/2011 Knudsen ..... E04H 12/2292 52/298
8,156,695 B2 4/2012 Smith
9,003,722 B2 4/2015 Smith
9,052,120 B2 * 6/2015 Villar ..... F24F 13/32
9,133,589 B2 * 9/2015 Ball ..... E01F 13/12
9,151,070 B2 10/2015 Smith
9,677,296 B2 6/2017 Smith
10,596,943 B2 * 3/2020 Strong ..... B32B 7/12
10,767,825 B2 * 9/2020 Chia ..... F21S 8/085
2006/0204327 A1 * 9/2006 Phelan ..... E01F 13/046 404/6

* cited by examiner

BOLLARD ASSEMBLY WITH STRESS CONTROL DEVICE

CROSS-REFERENCE TO RELATED APPLICATIONS

This application is a continuation-in-part of U.S. patent application Ser. No. 16/423,410, entitled "Bollard Assembly with Stress Control Device" and filed May 28, 2019, the entire disclosure of which is incorporated by reference herein.

FIELD OF THE INVENTION

The present invention relates to bollard posts and, more particularly, to bollard assemblies having bollard posts with a stress control device.

BACKGROUND

In the last few years it has become increasingly more obvious that there is a problem with low-speed vehicles impacting critical facilities and pedestrians in pedestrian or non-vehicular areas, particularly in areas that are adjacent to parking lots, such as storefronts and low-speed driveways such as those associated with schools, store-fronts, hospital emergency entrances, etc. These impacts can be the result of driver error, such as pressing an accelerator pedal instead of the brake pedal, or failure to control vehicle trajectory. In such cases, the vehicle impact speeds are typically 30 mile per hour (mph) or even 20 mph or less in parking lots.

In an effort to combat the problem of errant vehicle impacts, the use of steel pipe bollards to protect pedestrian or non-vehicular areas from low-speed errant vehicle impacts has become more prevalent. As can be seen in FIG. 1, in its simplest form, a bollard post 10, which is typically a 6 foot long steel pipe, is supported by a cylindrical concrete foundation pier 20 in the foundation soil 30. The bollard post 10 is positioned in a hole in the foundation soil 30, typically so that 3 feet of bollard post 10 is below grade and 3 feet of bollard post 10 extends above the foundation soil 30, and the hole is backfilled with concrete to for foundation pier 20 around bollard post 10. Bollard post 10 can also be filled with concrete. As shown in FIG. 2, in areas that have a sidewalk or other pavement 40, the pavement 40 can also be installed around bollard post 10 and on top of or around foundation pier 20.

One of the problems encountered with designing and installing bollards has been that building codes provided virtually no guidance for the structural design of low-speed bollards. As a result, there was no guidance relating to the proper structural design, construction, and placement of bollard posts and bollard installations. However, a standard test procedure has recently been published by ASTM that can be used to empirically evaluate the performance of bollards through the use of impact testing with a representative vehicle. Use of this standard to evaluate the performance of current bollard installations, coupled with forensic evaluations of actual bollard impacts, suggests that most current bollard installations provide very little structural protection and serve primarily to delineate the critical zone from the intended vehicle travel way, rather than prevent a vehicle from traveling into the critical zone.

For example, when a vehicle impacts the type of bollard installation shown in FIG. 1, a horizontal impact force F is applied to the bollard post 10 at roughly the bumper height of the impacting vehicle. This impact force F is transferred to the top of the foundation pier 20 as a horizontal shear force and overturning moment, both of which have to be resisted by the interaction of the foundation soil 30 and foundation pier 20. The resistance of foundation soil 30 involves an upper resultant force UF that acts in a direction opposite to impact force F and a lower resultant force LF that acts in the same direction as impact force F. However, this is an inefficient way to develop the required foundation resistance since the top portion of foundation soil 30 has very little stiffness compared to deeper soil layers of foundation soil 30. Therefore, this type of bollard installation requires a relatively deep foundation.

The performance of the bollard installation shown in FIG. 1 has the potential to be improved if the bollard installation is surrounded by a pavement 40 or sidewalk, typically concrete, as shown in FIG. 2. In such cases, the surrounding pavement 40 is typically of a thickness of 3 to 4 inches and is oriented so that it serves as a deep beam in the lateral direction. Under the right circumstances, the surrounding pavement 40 is capable of providing the upper resultant force UF acting against the direction of impact force F, which allows the entire strength of the foundation soil 30 to be devoted to the lower resultant force LF that acts in the same direction as impact force F. If the surrounding pavement 40 is capable of resisting the upper resultant force UF, it is possible to have a shallower foundation than the bollard installation shown in FIG. 1.

However, it has been determined through the forensic examination of impacted bollards of the type shown in FIG. 2 that the contact stress between the bollard post 10 and the pavement 40 often exceeds the bearing strength capacity of the pavement 40. When this happens, the bollard post 10 simply plows through the pavement 40 until an excessive deformation is reached and the vehicle launches because of excessive bollard rotation. This problem can be overcome by significantly increasing the dimensions of the foundation pier 20 so that the necessary support reactions can be developed without taking advantage of the strength of the surrounding pavement 40, however, this results in a much larger excavation of the foundation soil 30 and the use of much more material below grade for foundation pier 20 than is desirable.

SUMMARY

In accordance with one exemplary aspect of the present invention, a bollard assembly includes a bollard post, a ground sleeve configured to receive the bollard post, and a stress control device positioned adjacent to the ground sleeve. The stress control device comprises a face plate and a plurality of support plates that are angularly space from one another at equal angles and are secured to a back surface of the face plate and extending radially inward from the back surface towards the ground sleeve such that the ground sleeve fits between the plurality of support plates.

In further accordance with any one or more of the foregoing exemplary aspect of the present invention, the bollard assembly may further include, in any combination, any one or more of the following preferred forms.

In one preferred form, the plurality of support plates comprise four support plates and the support plates are angularly spaced 90 degrees from each other.

In another preferred form, the face plate is arcuate and has a radius of curvature greater than a radius of a minimum bounding circle of a cross-section of the ground sleeve.

In another preferred form, the ground sleeve is generally cylindrical and the radius of curvature of the face plate is greater than a radius of the ground sleeve.

In another preferred form, the face plate is generally cylindrical and substantially surrounds the ground sleeve.

In another preferred form, the stress control device comprises an inner ring radially inset from the face plate and configured to be attached to the ground sleeve. A first end of each of the plurality of support plates is secured to a back surface of the face plate and a second end of each of the plurality of support plates, opposite the first end, is secured to an outer surface of the inner ring.

In another preferred form, the inner ring comprises a first semi-circular portion and a second semi-circular portion secured to the first semi-circular portion to attach the inner ring to the ground sleeve.

In accordance with another exemplary aspect of the present invention, a stress control device for use with a bollard post includes a face plate and a plurality of support plates secured to a back surface of the face plate. The plurality of support plates extend radially inward from the back surface and are angularly spaced apart from one another at equal angles.

In further accordance with any one or more of the foregoing exemplary aspect of the present invention, the stress control device may further include, in any combination, any one or more of the following preferred forms.

In one preferred form, the plurality of support plates comprise four support plates and the support plates are angularly spaced 90 degrees from each other.

In another preferred form, the face plate is generally cylindrical.

In another preferred form, the stress control device comprises an inner ring radially inset from the face plate. A first end of each of the plurality of support plates is secured to a back surface of the face plate and a second end of each of the plurality of support plates, opposite the first end, is secured to an outer surface of the inner ring.

In another preferred form, the inner ring comprises a first semi-circular portion and a second semi-circular portion secured to the first semi-circular portion.

In another preferred form, the bollard assembly comprising a bollard post wherein the stress control device is positioned adjacent to the bollard post.

In another preferred form, the bollard post is generally cylindrical and the face plate is arcuate and has a radius of curvature greater than a radius of the bollard post.

In accordance with another exemplary aspect of the present invention, a method of installing a bollard assembly comprises the steps of: forming an aperture through a pavement; digging a hole in a foundation soil below the aperture in the pavement; positioning the bollard assembly through the aperture in the pavement and into the hole in the foundation soil such that the ground sleeve and a portion of the bollard post are positioned in the hole and the stress control device is positioned within the aperture in the pavement; and pouring a foundation pier around the ground sleeve, the foundation pier filling the hole in the foundation soil and the aperture in the pavement and completely covering the stress control device.

In further accordance with any one or more of the foregoing exemplary aspect of the present invention, the method may further include, in any combination, any one or more of the following preferred forms.

In one preferred form, the plurality of support plates comprise four support plates and the support plates are angularly spaced 90 degrees from each other.

In another preferred form, the ground sleeve is generally cylindrical and the face plate is arcuate and has a radius of curvature greater than a radius of the ground sleeve.

In another preferred form, the face plate is generally cylindrical and substantially surrounds the ground sleeve.

In another preferred form, the stress control device comprises an inner ring radially inset from the face plate and configured to be attached to the ground sleeve. A first end of each of the plurality of support plates is secured to a back surface of the face plate, a second end of each of the plurality of support plates, opposite the first end, is secured to an outer surface of the inner ring, and the method further comprises attaching the inner ring of the stress control device to the ground sleeve.

In another preferred form, the inner ring comprises a first semi-circular portion and a second semi-circular portion secured to the first semi-circular portion.

DETAILED DESCRIPTION

Figure 1:
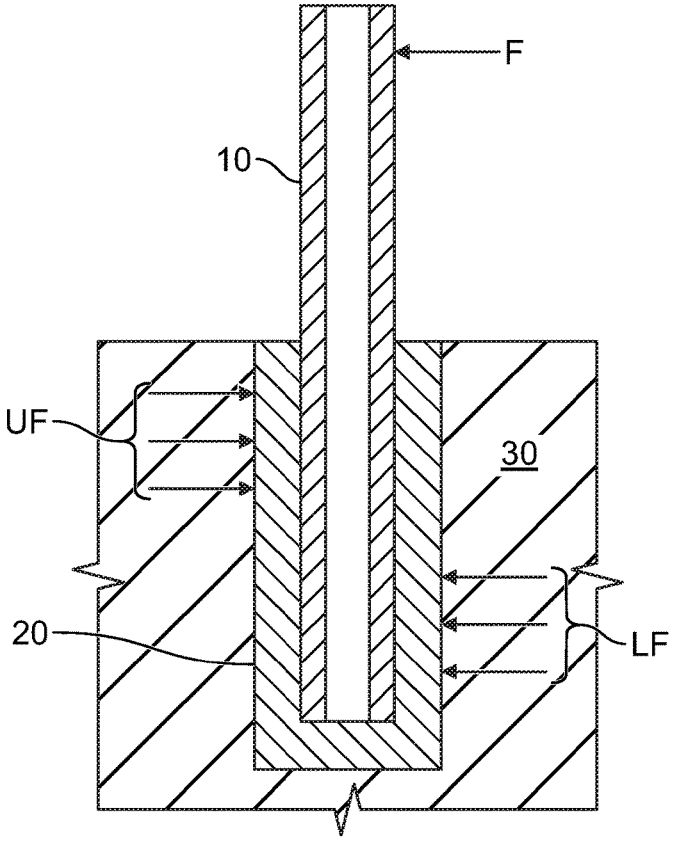
FIG. 1 (PRIOR ART)
FIG. 1 is a cross-sectional view of a known bollard post installed in a foundation pier.
Figure 2:
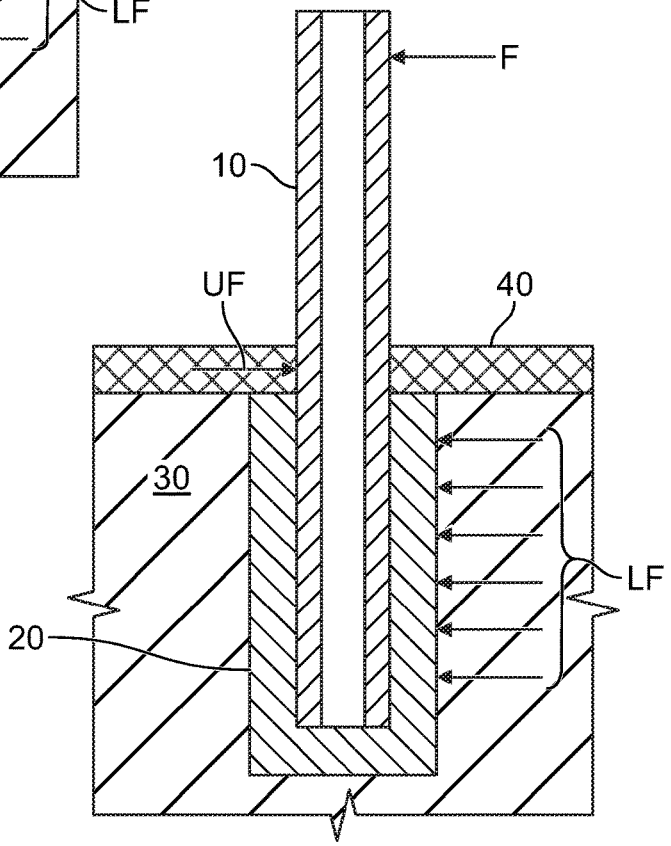
FIG. 2 (PRIOR ART)
FIG. 2 is a cross-sectional view of the bollard post of FIG. 1 surrounded by a pavement.

The bollard assemblies described herein improve the performance of foundation pier supported bollard installations in pavement by reducing the bearing stress between the bollard post and the surrounding concrete, asphalt, or other pavement so that the bollard post does not plow through the pavement. As shown herein, one way that this can be accomplished is through the use of a stress control device attached to the bollard post, which increases the contact area between the bollard post and the surrounding pavement. Use of a stress control device allows the dimensions of the foundation pier to be minimized, reduces the localized stresses imparted into the surround in such a way that the bollard post is prevented from "plowing" through the pavement when the bollard post is impacted, and can significantly increase the moment capacity of a simple concrete foundation pier since failure of the bollard assembly is controlled by the strength of the bollard post and not the strength of the localized strength of the surrounding pavement.

Referring to FIGS. 3A-7, one example bollard assembly 100 is shown installed in foundation soil 130 with a foundation pier 120 surrounded by pavement 140. Foundation pier 120 could be concrete, reinforced concrete (e.g., reinforced with rebar), or any other suitable material. Similarly, pavement 140 could be concrete, such as a sidewalk or walkway, asphalt, brick pavers, or any other suitable material.

Bollard assembly 100 generally includes a bollard post 110, such as a steel pipe, and a stress control device 150 that is positioned adjacent to bollard post 110. In the example shown, stress control device 150 has a face plate 155 and a pair of support plates 165 that are secured the back surface 160 of face plate 155 to reinforce face plate 155 and to provide lateral support to bollard post 110 to increase the strength of bollard post 110 against localized buckling. This helps develop the full plastic moment capacity of bollard post 110 during an impact. For example, face plate 155 and support plates 165 can be made of steel, which allows support plates 165 to be welded to back surface 160 of face plate 155. Support plates 165 are spaced apart from one another so that they are positioned on opposite sides of bollard post 110 and bollard post 110 fits between support plates 165 with stress control device 150 positioned adjacent bollard post 110. Preferably, support plates 165 fit snugly around bollard post 110.

As shown, stress control device 150 can also be attached to bollard post 110 to simplify installation of bollard assembly 100. Stress control device 150 can be attached to bollard post 110 by bolting or welding stress control device 150 to bollard post 110 to hold stress control device 150 in place as foundation pier 120 is poured. In the example shown, stress control device 150 includes a U-bolt 170 that is configured to attach face plate 155 to bollard post 110 to hold stress control device 150 to bollard post 110 during pouring of the concrete or other material for foundation pier 120, which provides more installation flexibility compared to welding. If used with U-bolt 170, face plate 155 can have a pair of apertures 157 (FIG. 6) that are configured to receive opposing legs of U-bolt 170.

Figure 3A:
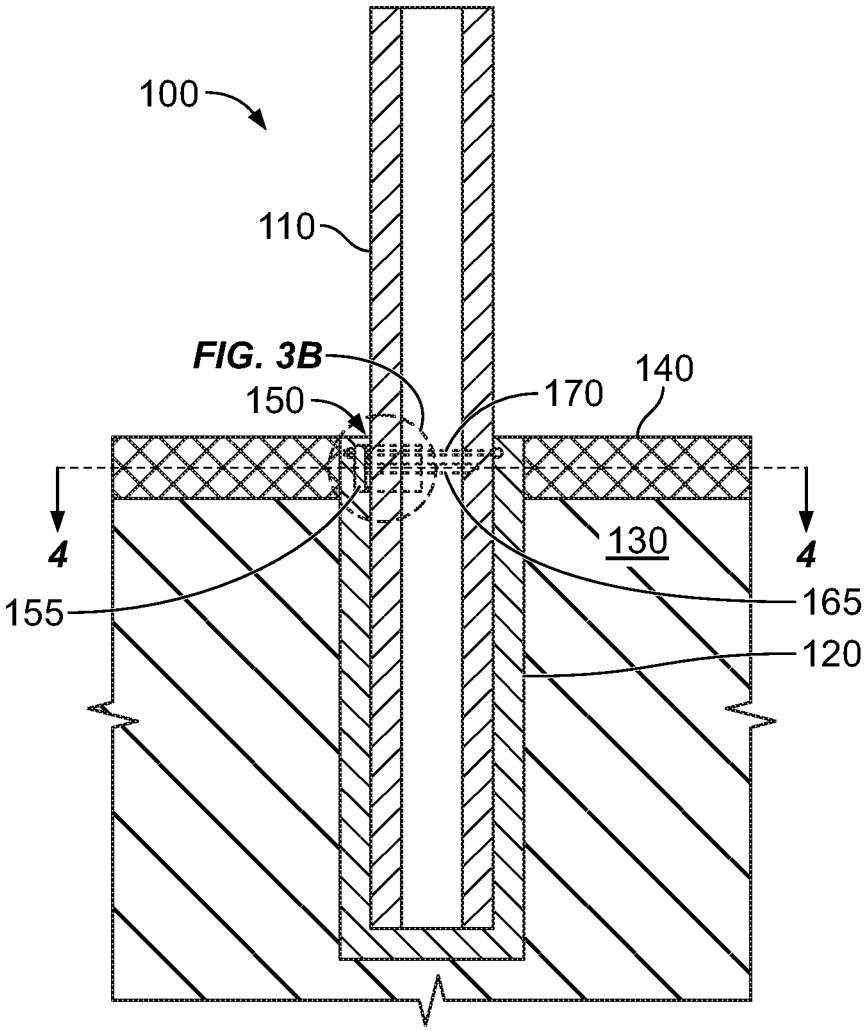
FIG. 3A is a cross-sectional view of an example bollard assembly installed in a foundation pier and surrounded by a pavement.
Figure 3B:
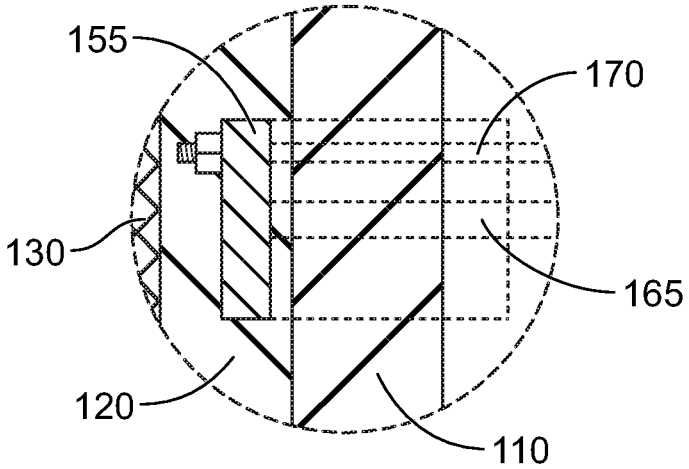
FIG. 3B is an enlarged view of a portion of the bollard assembly of FIG. 3A.
Figure 4:
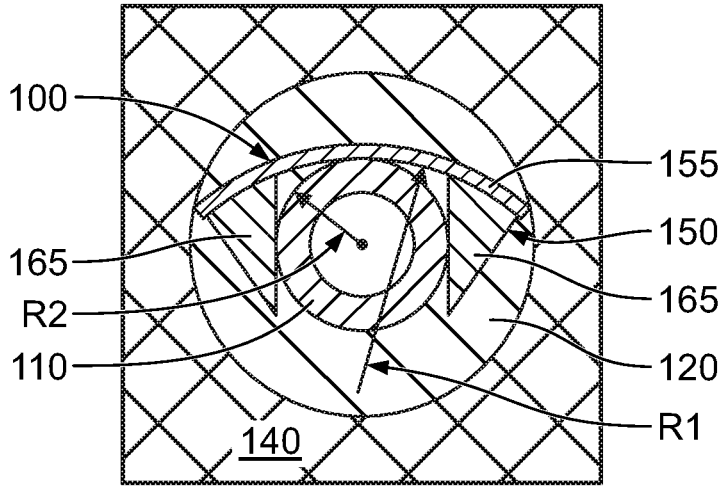
FIG. 4 is a cross-sectional view of the bollard assembly of FIG. 3A taken along line 4-4 of FIG. 3A.
Figure 5:
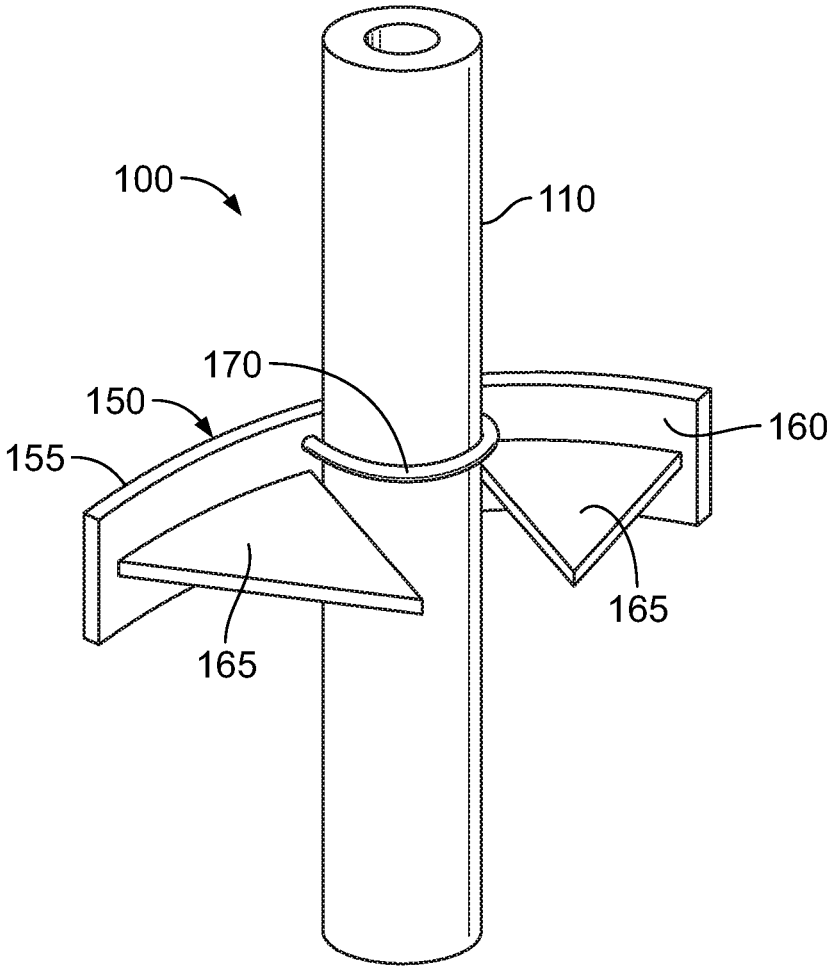
FIG. 5 is a perspective view of the bollard assembly of FIG. 3A.
Figure 6:
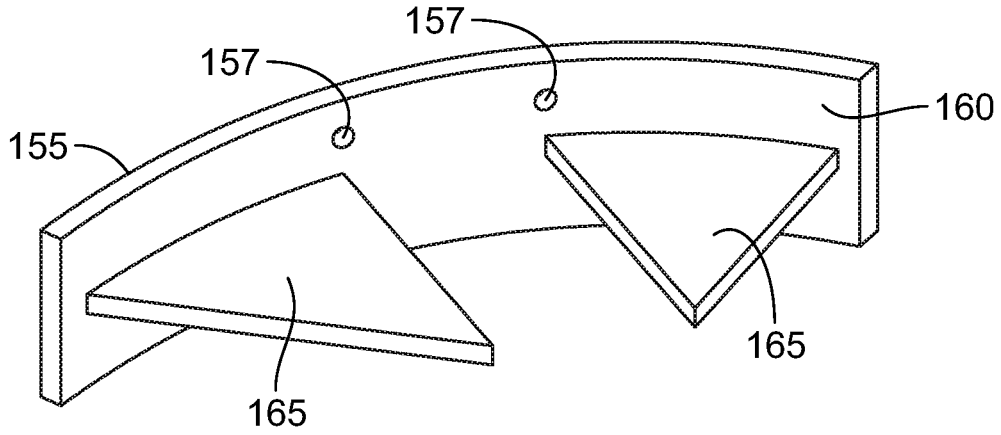
FIG. 6 is a perspective view of the stress control device of the bollard assembly of FIG. 5 with the U-bolt removed.
Figure 7:
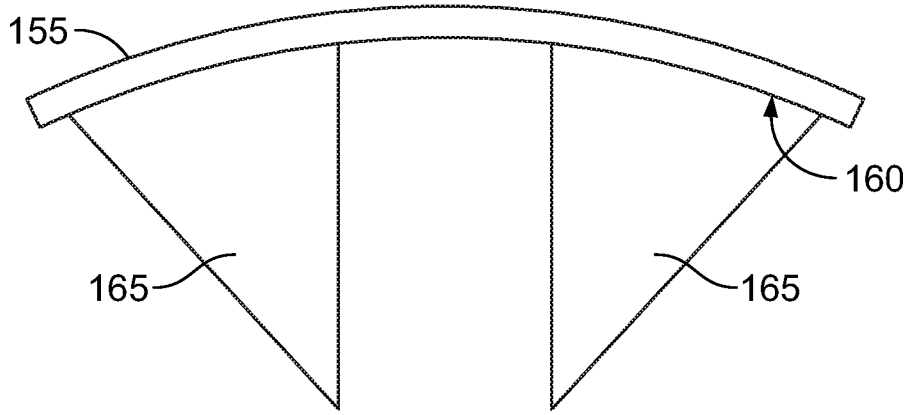
FIG. 7 is a top view of the stress control device of FIG. 6.

Face plate 155 is arcuate and has a radius of curvature R1 that is greater than the radius of a minimum bounding circle of a cross-section of bollard post 110. The minimum bounding circle is the smallest circle possible that contains or bounds the entire cross-section of the bollard post. In the example shown, bollard post 110 is generally cylindrical, as shown in FIGS. 3-5, and the radius of curvature R1 of face plate 155 is greater than the radius R2 of bollard post 110 (see FIG. 4). This configuration effectively extends the contact area between bollard post 110 and pavement 140 on the compression side of the impact.

Figure 8:
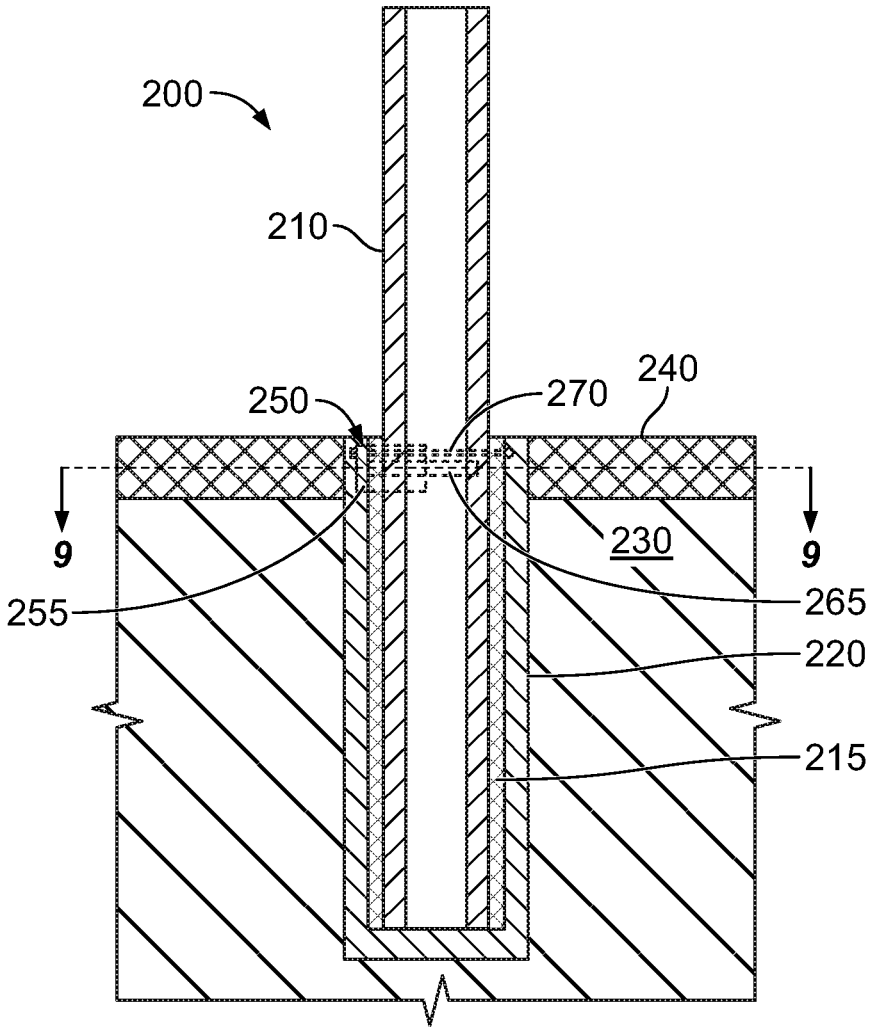
FIG. 8 is a cross-sectional view of another example bollard assembly installed in a foundation pier and surrounded by a pavement.
Figure 9:
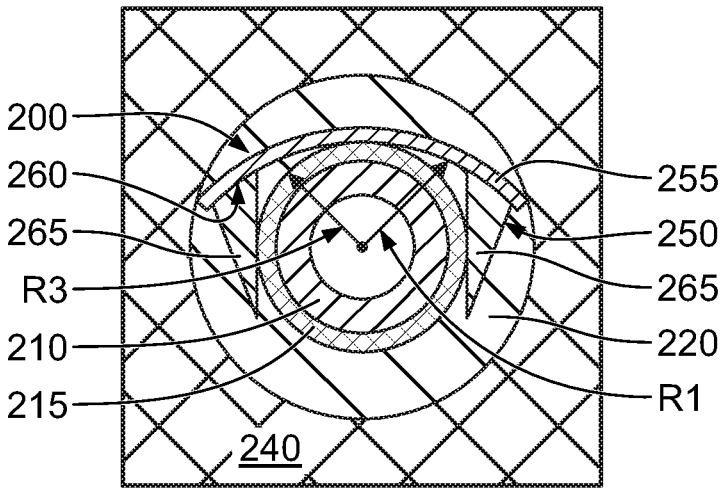
FIG. 9 is a cross-sectional view of the bollard assembly of FIG. 8 taken along line 9-9 in FIG. 8.

Referring to FIGS. 8-9, another example bollard assembly 200 is shown that is similar to bollard assembly 100 described above, but includes a ground sleeve 215 that is installed in foundation soil 230 with foundation pier 220 and receives bollard post 210, rather than securing bollard post 210 directly in foundation pier 220. As described above, foundation pier 220 could be concrete, reinforced concrete (e.g., reinforced with rebar), or any other suitable material and pavement 240 could be concrete, such as a sidewalk or walkway, asphalt, brick pavers, or any other suitable material.

Bollard assembly 200 generally includes a bollard post 210, such as a steel pipe, a ground sleeve 215 that is configured to receive bollard post 210, and a stress control device 250 that is positioned adjacent to ground sleeve 215. In the example shown, stress control device 250 has a face plate 255 and a pair of support plates 265 that are secured to the back surface 260 of face plate 255 to reinforce face plate 255 and to provide lateral support to ground sleeve 215 and bollard post 210 to increase the strength against localized buckling and helps develop the full plastic moment capacity during an impact. For example, face plate 255 and support plates 265 can be made of steel, which allows support plates 265 to be welded to back surface 260 of face plate 255. Support plates 265 are spaced apart from one another so that they are positioned on opposite sides of ground sleeve 215 and ground sleeve 215 fits between support plates 265 with stress control device 250 positioned adjacent to ground sleeve 215. Preferably, support plates 265 fit snugly around ground sleeve 215.

As shown, stress control device 250 can also be attached to ground sleeve 215 to simplify installation of bollard assembly 200. Stress control device 250 can be attached to ground sleeve 215 by bolting or welding stress control device 250 to ground sleeve 215 to hold stress control device 250 in place as foundation pier 220 is poured. In the example shown, stress control device 250 includes a U-bolt 270 that is configured to attach face plate 255 to ground sleeve 215 to hold stress control device 250 to ground sleeve 215 during pouring of the concrete or other material for foundation pier 220, which provides more installation flexibility compared to welding. If used with U-bolt 270, face plate 255 can have a pair of apertures (not shown) that are configured to receive opposing legs of U-bolt 270.

Face plate 255 is arcuate and has a radius of curvature R1 that is greater than the radius of a minimum bounding circle of a cross-section of ground sleeve 215. The minimum bounding circle is the smallest circle possible that contains or bounds the entire cross-section of the ground sleeve. In the example shown, ground sleeve 215 is generally cylindrical, as shown in FIG. 9, and the radius of curvature R1 of face plate 255 is greater than the radius R3 of ground sleeve 215. This configuration effectively extends the contact area between ground sleeve 215 and pavement 240 on the compression side of the impact.

Figure 10:
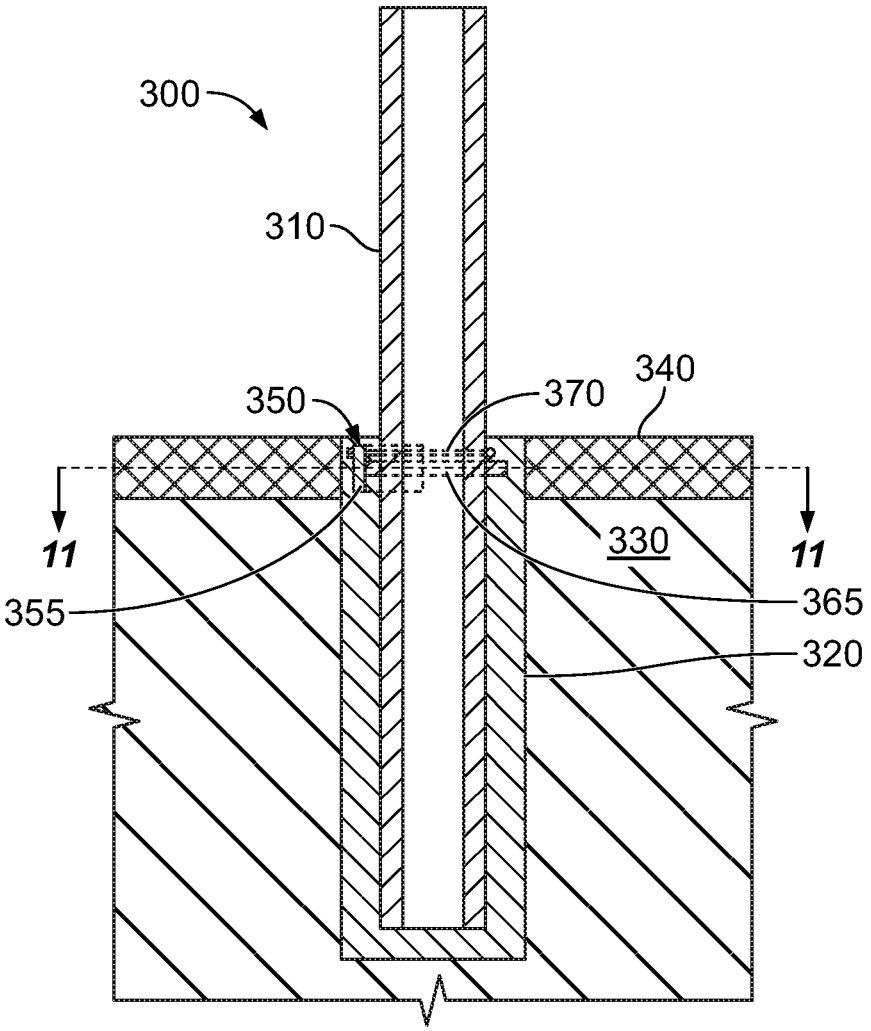
FIG. 10 is a cross-sectional view of yet another example bollard assembly installed in a foundation pier and surrounded by a pavement.
Figure 11:
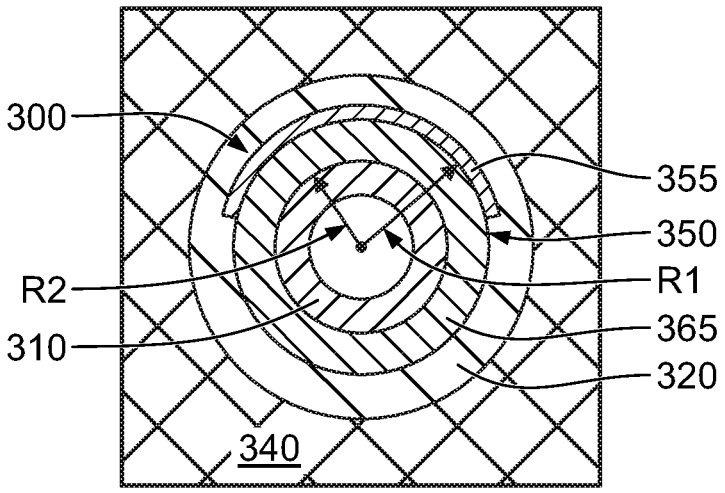
FIG. 11 is a cross-sectional view of the bollard assembly of FIG. 10 taken along the line 11-11 in FIG. 10.
Figure 12:
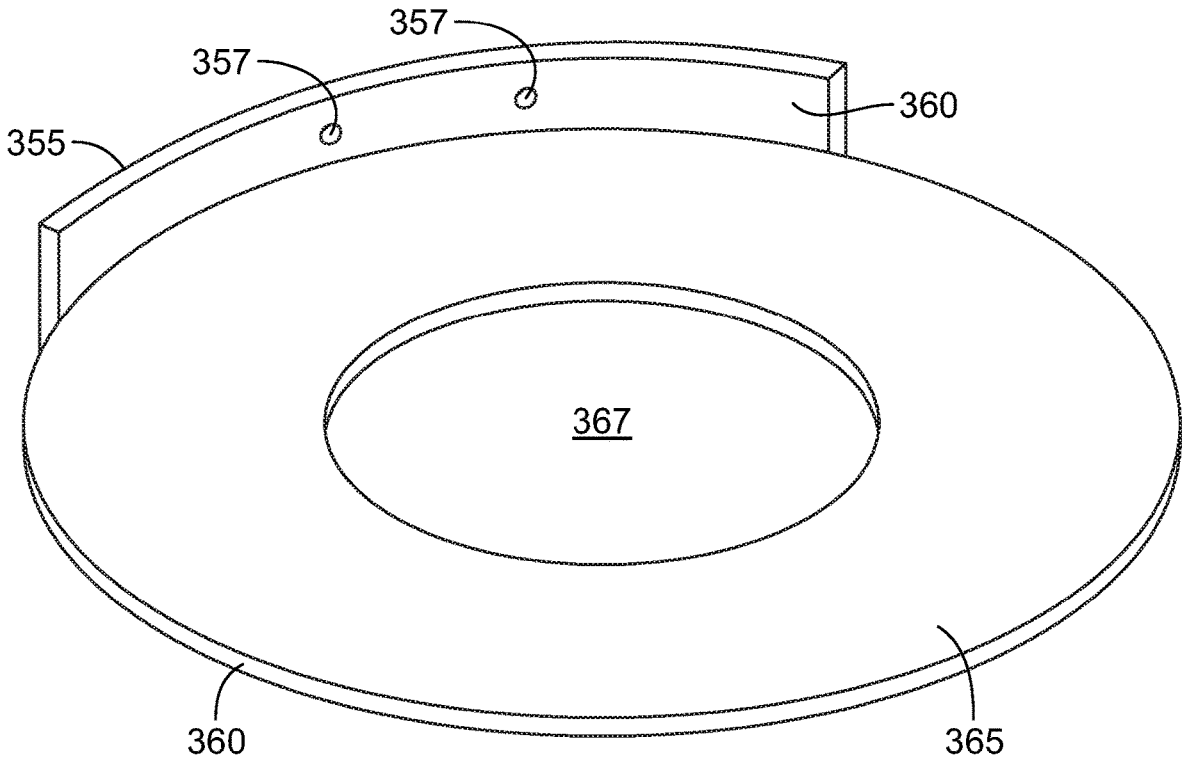
FIG. 12 is a perspective view of the stress control device of the bollard assembly of FIG. 10.
Figure 13:
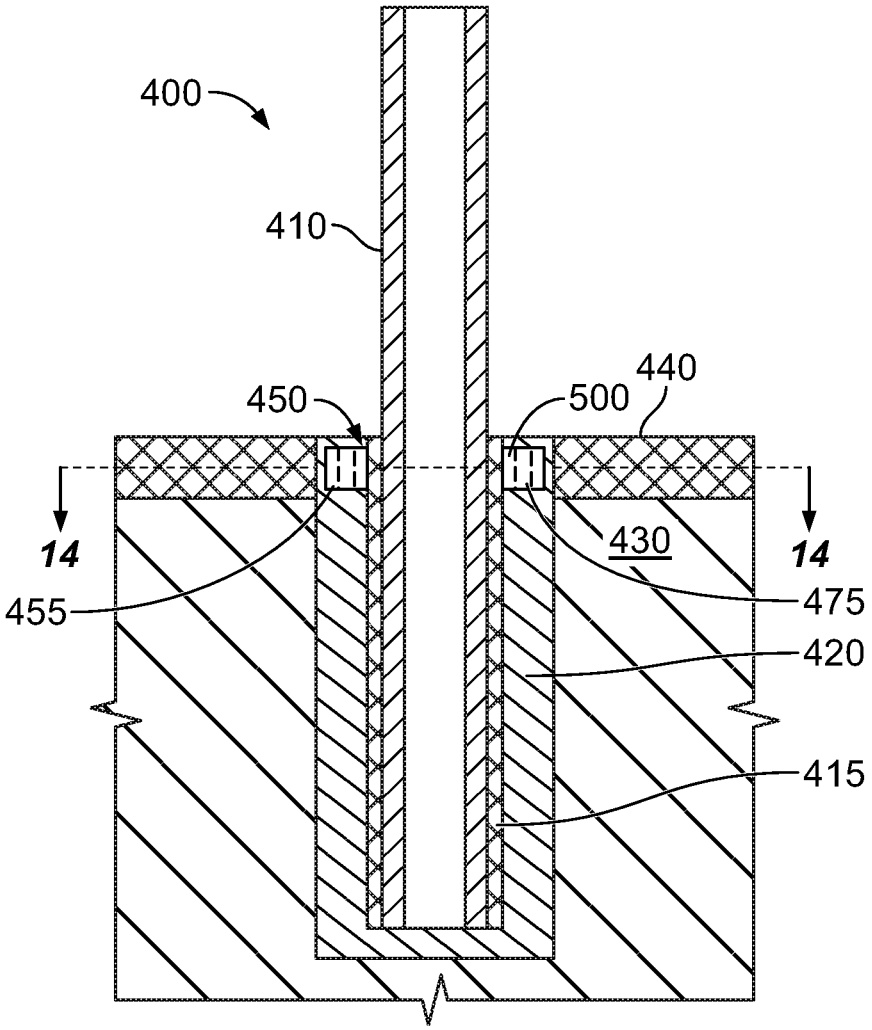
FIG. 13 is a cross-sectional view of another example bollard assembly installed in a foundation pier and surrounded by pavement.

Referring to FIGS. 10-12, another example bollard assembly 300 is shown installed in foundation soil 330 with a foundation pier 320 surrounded by pavement 340. As described above, foundation pier 320 could be concrete, reinforced concrete (e.g., reinforced with rebar), or any other suitable material and pavement 340 could be concrete, such as a sidewalk or walkway, asphalt, brick pavers, or any other suitable material.

Bollard assembly 300 generally includes a bollard post 310, such as a steel pipe, and a stress control device 350 that is positioned adjacent to bollard post 310. Stress control device 350 can also be used with a ground sleeve installation as described above by positioning stress control device 350 adjacent the ground sleeve rather than the bollard post, which is received in the ground sleeve. In the example shown, stress control device 350 has a generally disc shaped support plate 365 that surrounds bollard post 310 and includes an aperture 367 that is configured to receive bollard post 310. Face plate 355 is attached to an outer surface 368 of support plate 365 such that face plate 355 is spaced apart from aperture 367 and bollard post 310, which reinforces face plate 355 and provides lateral support to bollard post 310 to increase the strength of bollard post 310 against localized buckling. This helps develop the full plastic moment capacity of bollard post 310 during an impact. For example, face plate 355 and support plate 365 can be made of steel, which allows face plate 355 to be welded to outer surface 368 of support plate 365. Aperture 367 in support plate 365 is sized and shaped so that bollard post 310 fits within aperture 367 with stress control device 350 positioned adjacent bollard post 310. Preferably, support plate 365 fit snugly around bollard post 310.

As shown, stress control device 350 can also be attached to bollard post 310 to simplify installation of bollard assembly 300. Stress control device 350 can be attached to bollard post 310 by bolting or welding stress control device 350 to bollard post 310 to hold stress control device 350 in place as foundation pier 320 is poured. In the example shown, stress control device 350 includes a U-bolt 370 that is configured to attach face plate 355 to bollard post 310 to hold stress control device 350 to bollard post 310 during pouring of the concrete or other material for foundation pier 320, which provides more installation flexibility compared to welding. If used with U-bolt 370, face plate 355 can have a pair of apertures 357 (FIG. 12) that are configured to receive opposing legs of U-bolt 370.

Face plate 355 is arcuate and has a radius of curvature R1 that is greater than the radius of a minimum bounding circle of a cross-section of bollard post 310. The minimum bounding circle is the smallest circle possible that contains or bounds the entire cross-section of the bollard post. In the example shown, bollard post 310 is generally cylindrical, as shown in FIG. 11, and the radius of curvature R1 of face plate 355 is greater than the radius R2 of bollard post 310. This configuration effectively extends the contact area between bollard post 310 and pavement 340 on the compression side of the impact. Alternatively, face plate 355 could be generally cylindrical and could completely surround support plate 365.

To install one of the bollard assemblies 100, 200, 300 described herein, an aperture having a diameter or outer circumference greater than that of the bollard post 110, 310/ground sleeve 215 is formed through the pavement 140, 240, 340. A hole is then dug in the foundation soil 130, 230, 330 below the aperture in the pavement 140, 240, 340 and the bollard assembly 100, 200, 300 is positioned through the aperture in the pavement 140, 240, 340 and into the hole in the foundation soil 130, 230, 330 so that a portion of the bollard post 110, 310 (or the entire ground sleeve 215) is positioned in the hole and the corresponding stress control device 150, 250, 350 is positioned within the aperture in the pavement 140, 240, 340. If desired, the stress control device 150, 250, 350 can also be attached to the bollard post 110, 310/ground sleeve 215 prior to the bollard assembly 100, 200, 300 being positioned through the aperture and into the hole. As discussed above, the stress control device can be attached to the bollard post/ground sleeve through bolting or welding the stress control device to the bollard post/ground sleeve. Preferably, the bollard assembly 100, 200, 300 is positioned such that the face plate 155, 255, 355 is above the foundation soil 130, 230, 330 and below an upper surface of the pavement 140, 240, 340. If the radius of curvature of the face plate allows, the bollard assembly and also be positioned such that the outer surface the face plate is adjacent the inner surface of the aperture in the pavement. The foundation pier 120, 220, 320 is then poured around the bollard assembly 100, 200, 300 so that the foundation pier 120, 220, 320 fills the hole in the foundation soil 130, 230, 330 and the aperture in the pavement 140, 240, 340 and completely covers the stress control device 150, 250, 350.

Referring to FIGS. 13-17, another example bollard assembly 400 is shown that includes a ground sleeve 415 that is installed in foundation soil 430 with foundation pier 420 surrounded by pavement 440 and receives a bollard post 410. As described above, foundation pier 420 could be concrete, reinforced concrete (e.g., reinforced with rebar), or any other suitable material and pavement 440 could be concrete, such as a sidewalk or walkway, asphalt, brick pavers, or any other suitable material.

Figure 18:
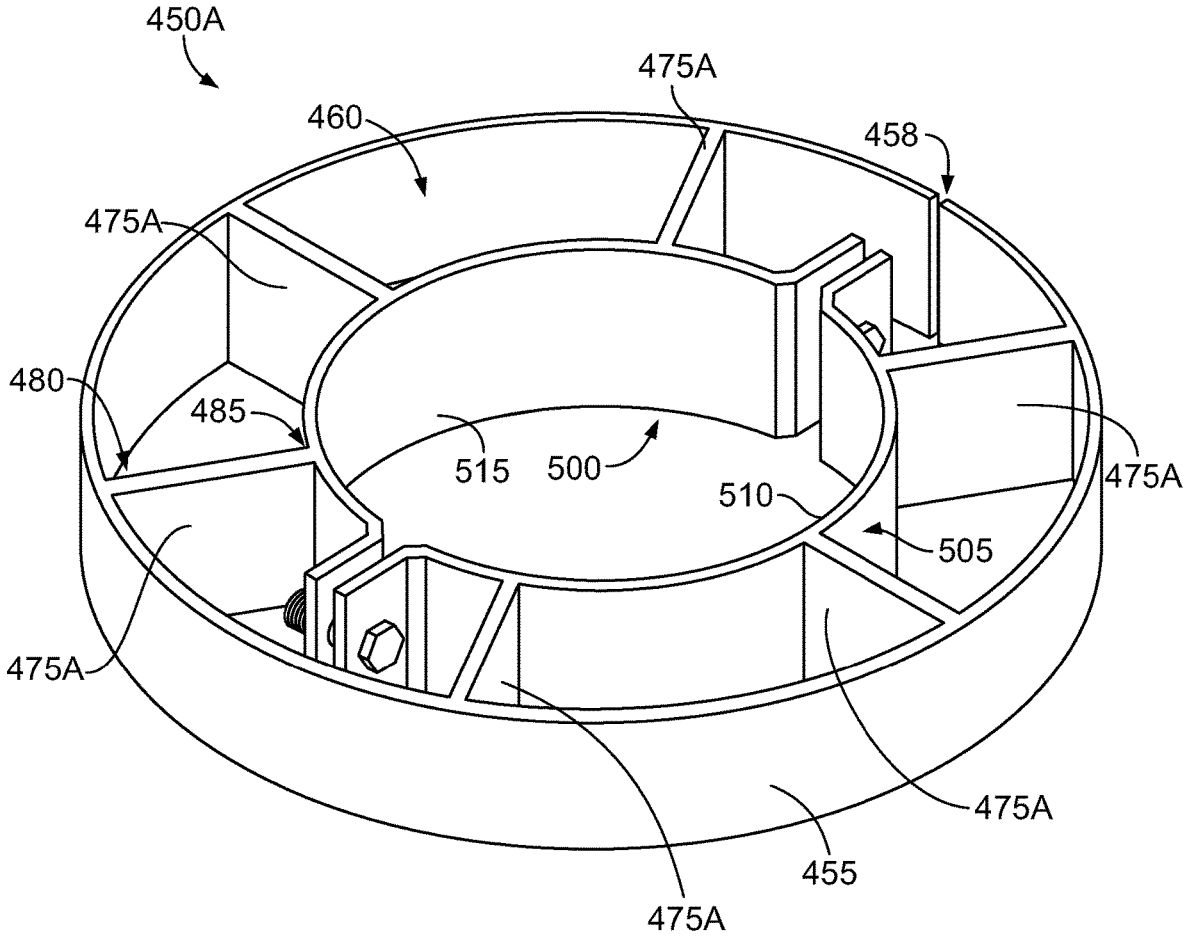
FIG. 18 is a perspective view of another example stress control device that can be used with the bollard assembly of FIG. 15.
Figure 19:
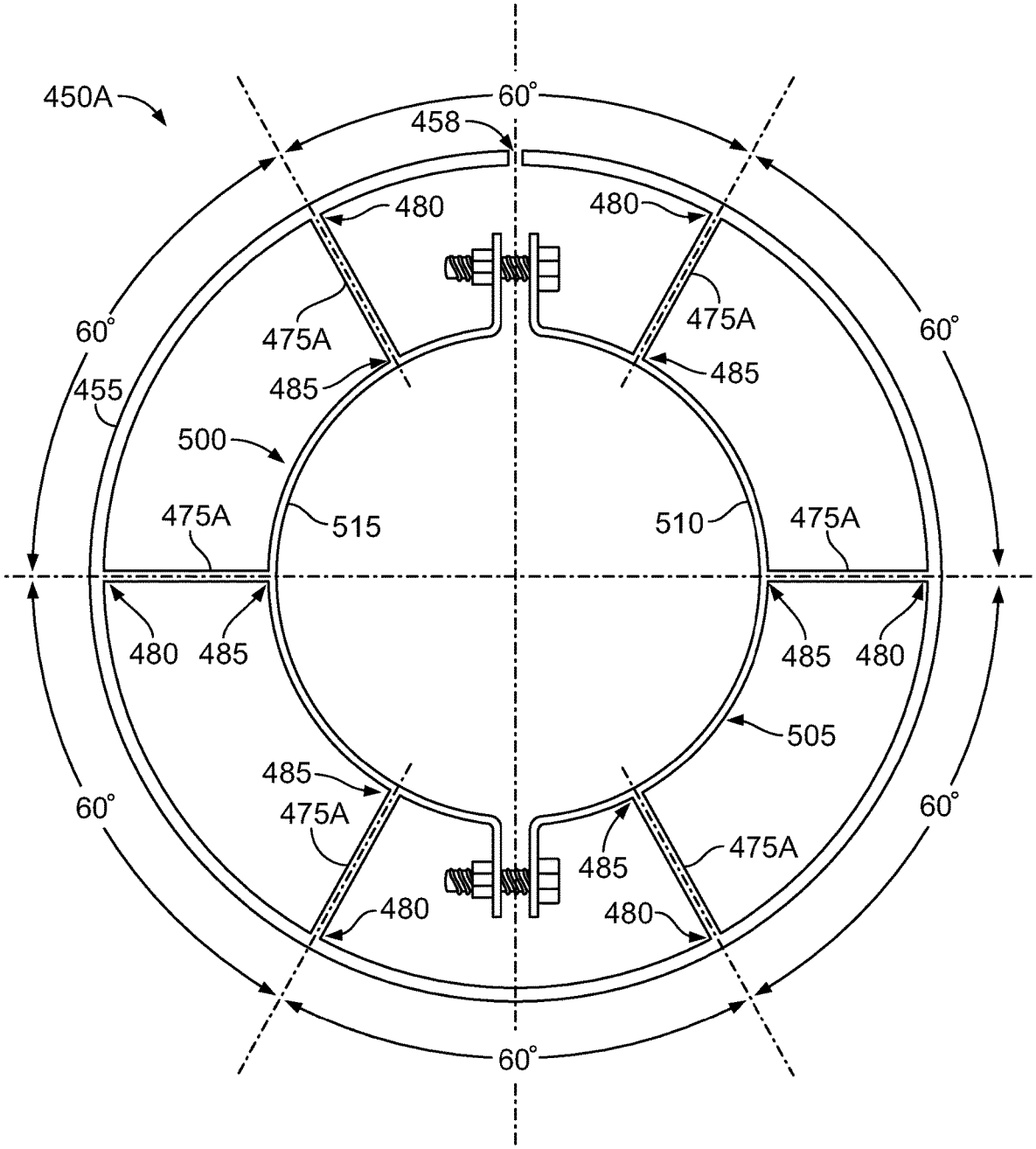
FIG. 19 is a top view of the stress control device of FIG. 18.

Bollard assembly 400 generally includes bollard post 410, such as a steel pipe, ground sleeve 415 that is configured to receive bollard post 410, and a stress control device 450 that is positioned adjacent to ground sleeve 415. In the example shown, stress control device 450 has a face plate 455 and a plurality of support plates 475 that each have a first end 480 that is secured to back surface 460 of face plate 455. Support plates 475 extend radially inward from back surface 460 towards ground sleeve 415 such that ground sleeve 415 fits between second ends 485 of support plates 475 and are angularly spaced from one another at equal angles to reinforce face plate 455 and to provide lateral support to ground sleeve 415 and bollard post 410 to increase the strength against localized buckling and help develop the full plastic moment capacity during an impact. In the example shown in FIGS. 13-17, there are four support plates 475 that are angularly spaced from one another at 90 degrees. However, there could be as little as three support plates angularly spaced at 120 degrees or as many support plates as desired. For example, as shown in FIGS. 18-19, another example stress control device 450A is shown that can have six support plates 475A that are angularly spaced from one another at 60 degrees. Face plate 455 and support plates 475 can be made of steel, which allows support plates 475 to be welded to back surface 460 of face plate 455.

Stress control device 450 can also be attached to ground sleeve 415 to simplify installation of bollard assembly 400. Stress control device 450 can be attached to ground sleeve 415 by in any manner desired, such as welding stress control device 450 to ground sleeve 415 to hold stress control device 450 in place as foundation pier 420 is poured. In the particular example shown, stress control device 450 includes an inner ring 500 that is radially inset from face plate 455, is configured to be attached to ground sleeve 415, and has second end 485 of each support plate 475, opposite first end 480, secured to outer surface 505 of inner ring 500. As shown, inner ring 500 includes a first semi-circular portion 510 and a mirror image second semi-circular portion 515 that surround ground sleeve 415 and are secured to each other to attached inner ring 500 to ground sleeve 415. In the example shown, first portion 510 is secured to second portion 515 with threaded members that extend through holes in flanges in first and second portions 510, 515 and are secured by nuts, however, first and second portions 510, 515 can be secured in any manner desired.

Figure 14:
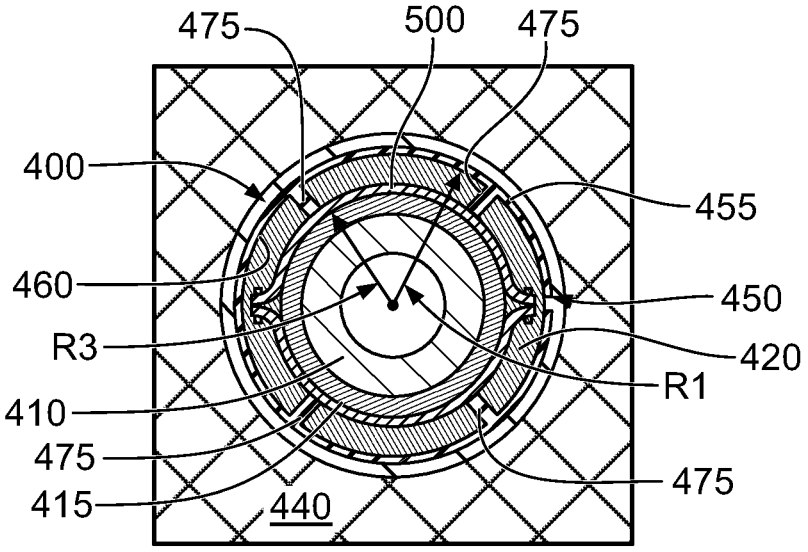
FIG. 14 is a cross-sectional view of the bollard assembly of FIG. 13 taken along line 14-14 in FIG. 13.
Figure 15:
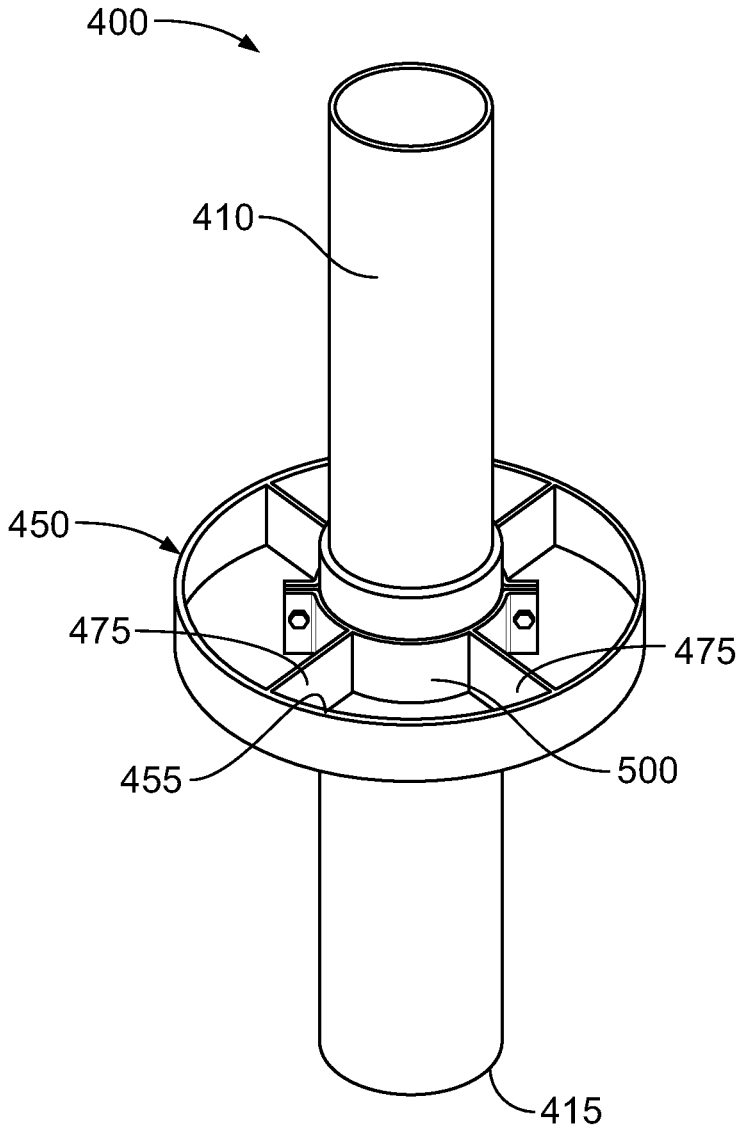
FIG. 15 is a perspective view of the bollard assembly of FIG. 13.
Figure 16:
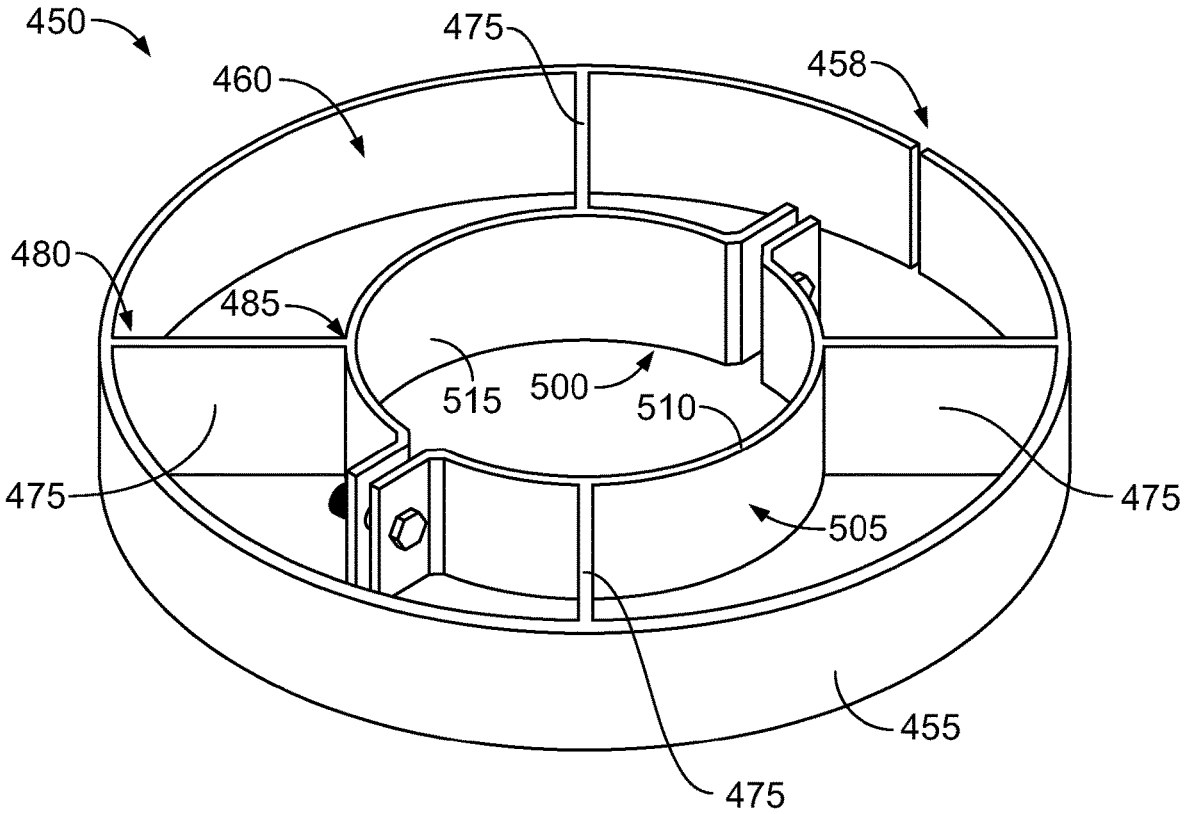
FIG. 16 is a perspective view of the example stress control device of the bollard assembly of FIG. 15.
Figure 17:
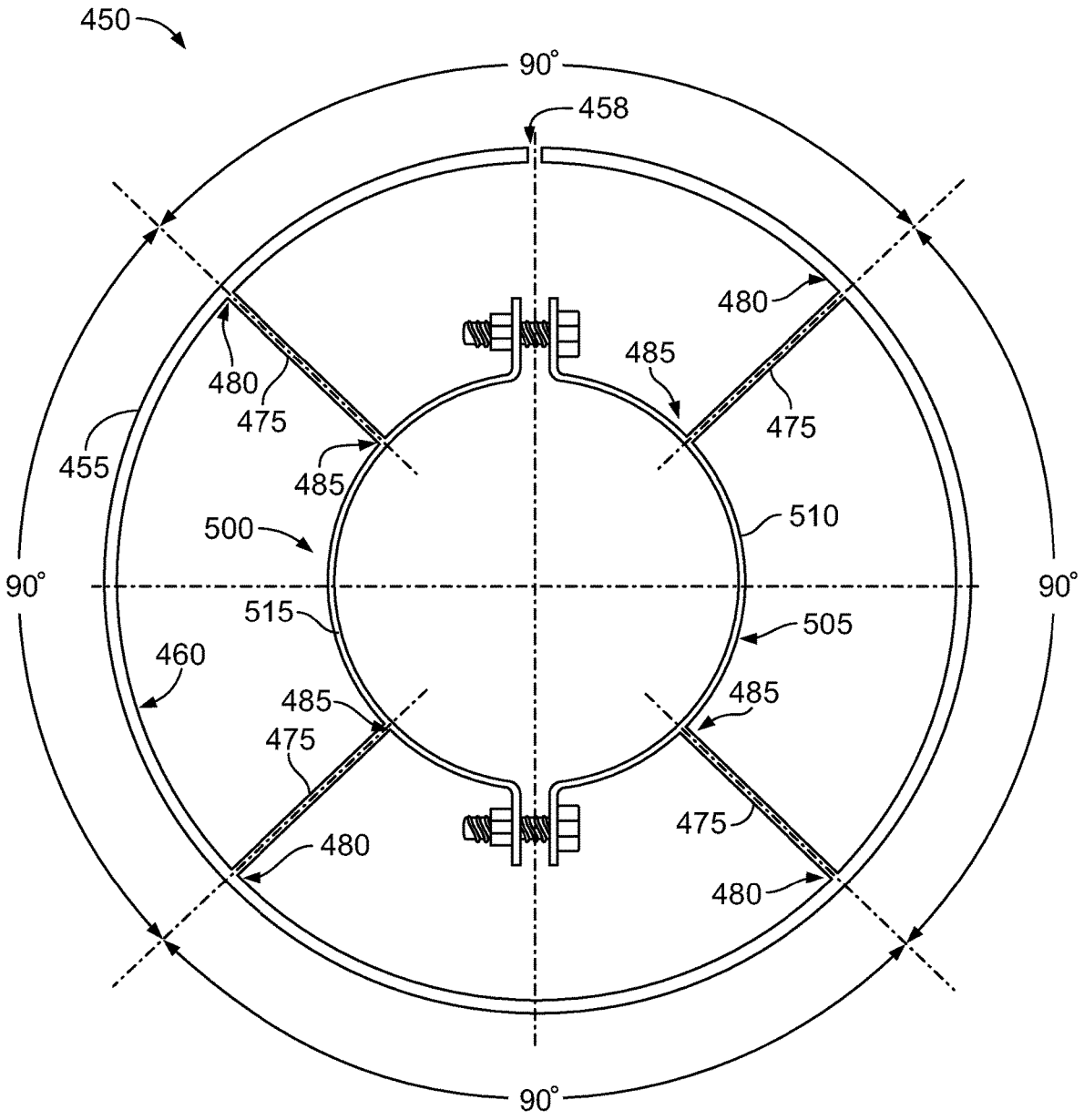
FIG. 17 is a top view of the stress control device of FIG. 16.

Face plate 455 is arcuate and has a radius of curvature R1 that is greater than the radius of a minimum bounding circle of a cross-section of ground sleeve 415. The minimum bounding circle is the smallest circle possible that contains or bounds the entire cross-section of the ground sleeve. In the example shown, ground sleeve 415 is generally cylindrical, as shown in FIG. 14, and the radius of curvature R1 of face plate 455 is greater than the radius R3 of ground sleeve 415. Face plate 455 is also shown as being generally cylindrical and substantially surrounding ground sleeve 415, which simplifies installation by not requiring that stress control device 450 be aligned in any particular direction to correspond to an expected or predicted direction of potential impact. However, face plate 455 could have any circumferential length and surround as much of ground sleeve 414 as desired. In addition, face plate 455 preferably includes a small gap 458 to allow face plate to flex during installation.

To install bollard assembly 400, an aperture having a diameter or outer circumference greater than that of ground sleeve 415 is formed through pavement 440. A hole is then dug in foundation soil 430 below the aperture in pavement 440 and bollard assembly 400 is positioned through the aperture in pavement 440 and into the hole in foundation soil 430 so that ground sleeve 415 and a portion of bollard post 410 are positioned in the hole and stress control device 450 is positioned within the aperture in pavement 440. If desired, stress control device 450 can also be attached to ground sleeve 415, as described above, prior to bollard assembly 400 being positioned through the aperture and into the hole. Preferably, bollard assembly 400 is positioned such that face plate 455 is above foundation soil 430 and below an upper surface of pavement 440 and an outer surface of face plate 455 is adjacent the inner surface of the aperture in pavement 440. Foundation pier 420 is then poured around ground sleeve 415 so that foundation pier 420 fills the hole in foundation soil 430 and the aperture in pavement 440 and completely covers stress control device 450.

Figure 20:
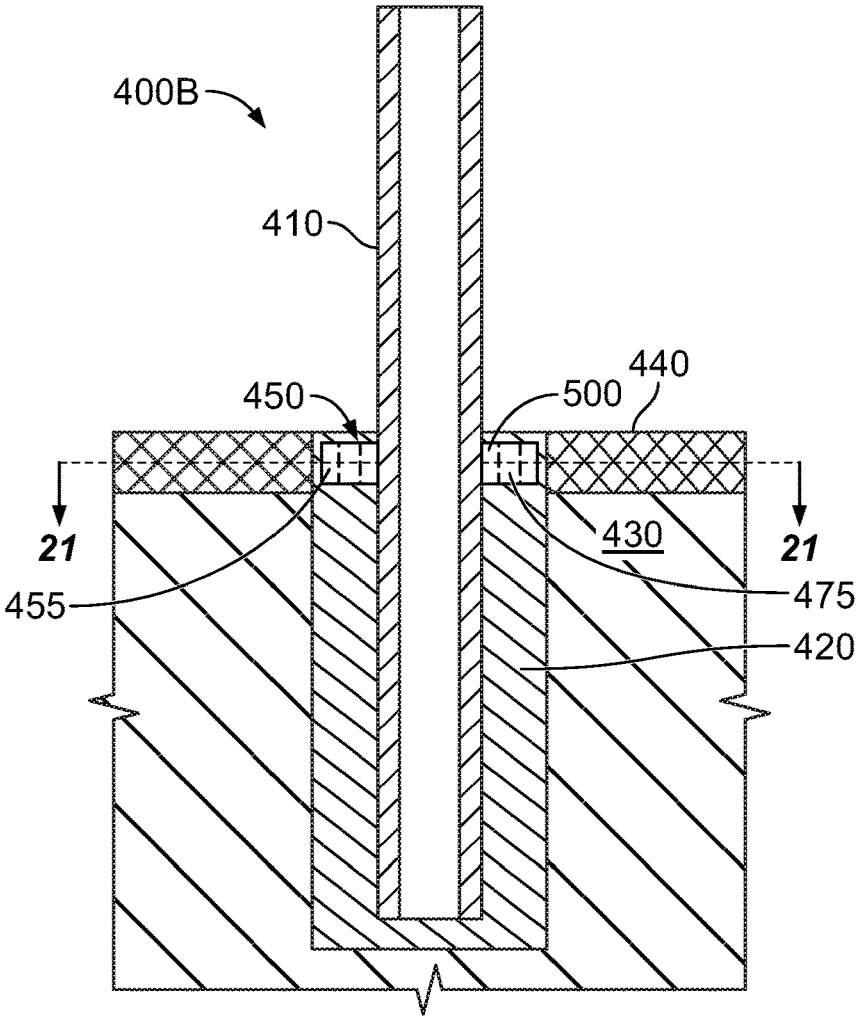
FIG. 20 is a cross-sectional view of another example bollard assembly installed in a foundation pier and surrounded by pavement.
Figure 21:
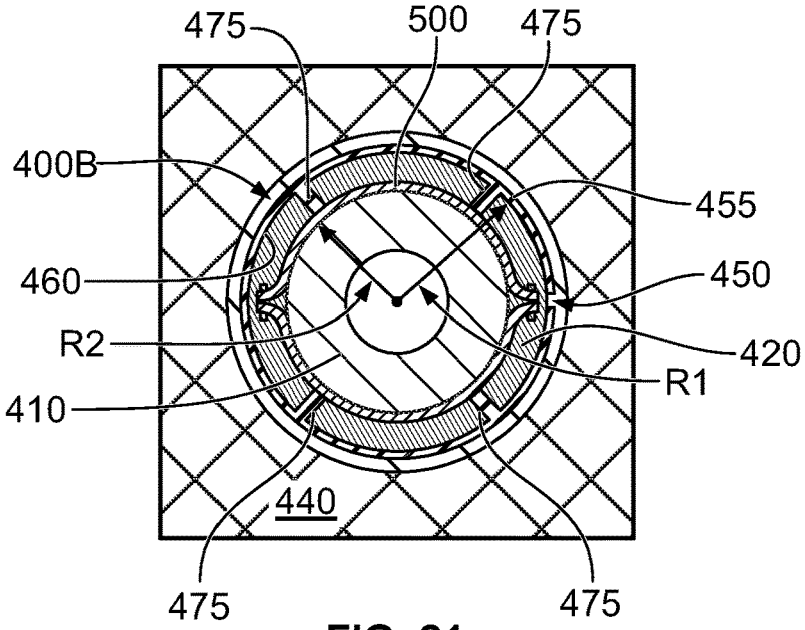
FIG. 21 is a cross-sectional view of the bollard assembly of FIG. 20 taken along line 21-21 of FIG. 20.

Referring to FIGS. 20-21, another example bollard assembly 400B is shown that is generally the same as bollard assembly 400 described above, except that bollard assembly 400B does not have ground sleeve 415 and stress control device 450 is positioned adjacent to bollard post 410 and secured around and to bollard post 410. In this example, support plates 475 extend radially inward from back surface 460 towards bollard post 410 such that bollard post 410 fits between second ends 485 of support plates 475 to reinforce face plate 455 and to provide lateral support to bollard post 410 to increase the strength against localized buckling and help develop the full plastic moment capacity during an impact. In addition, face plate 455 has a radius of curvature R1 that is greater than the radius of a minimum bounding circle of a cross-section of bollard post 410. In the example shown, bollard post 410 is generally cylindrical, as shown in FIG. 21, and the radius of curvature R1 of face plate 455 is greater than the radius R2 of bollard post 410.

The examples described and shown in detail herein are only exemplary of one or more aspects of the teachings of the present disclosure for the purpose of teaching a person of ordinary skill to make and use the invention or inventions recited in the appended claims. Additional aspects, arrangements, and forms of the invention or inventions within the scope of the appended claims are contemplated, the rights to which are expressly reserved.

What is claimed:

1. A bollard assembly, comprising:
a bollard post;
a ground sleeve configured to receive the bollard post; and
a stress control device positioned adjacent to the ground sleeve, the stress control device comprising:
a face plate having a gap to allow the face plate to flex during installation;
an inner ring radially inset from the face plate and configured to be attached to the ground sleeve, the inner ring comprising a first semi-circular portion and a second semi-circular portion removably secured to the first semi-circular portion with threaded members to removably attach the inner ring to the ground sleeve; and
a plurality of support plates secured to a back surface of the face plate and extending radially inward from the back surface towards the ground sleeve such that the ground sleeve fits between the plurality of support plates, the plurality of support plates being angularly spaced from one another at equal angles;
a first end of each of the plurality of support plates is secured to the back surface of the face plate; and
a second end of each of the plurality of support plates, opposite the first end, is secured to an outer surface of the inner ring.

2. The bollard assembly of claim 1, wherein the plurality of support plates comprise four support plates and the support plates are angularly spaced 90 degrees from each other.

3. The bollard assembly of claim 1, wherein the face plate is arcuate and has a radius of curvature greater than a radius of a minimum bounding circle of a cross-section of the ground sleeve.

4. The bollard assembly of claim 3, wherein the ground sleeve is generally cylindrical and the radius of curvature of the face plate is greater than a radius of the ground sleeve.

5. The bollard assembly of claim 1, wherein the face plate is generally cylindrical and substantially surrounds the ground sleeve.

6. A stress control device for use with a bollard assembly, the stress control device comprising:
a face plate having a gap to allow the face plate to flex during installation;
an inner ring radially inset from the face plate, the inner ring comprising a first semi-circular portion and a second semi-circular portion removably secured to the first semi-circular portion with threaded members; and
a plurality of support plates secured to a back surface of the face plate and extending radially inward from the back surface; wherein
the plurality of support plates are angularly spaced from one another at equal angles;
a first end of each of the plurality of support plates is secured to the back surface of the face plate; and
a second end of each of the plurality of support plates, opposite the first end, is secured to an outer surface of the inner ring.

7. The stress control device of claim 6, wherein the plurality of support plates comprise four support plates and the support plates are angularly spaced 90 degrees from each other.

8. The stress control device of claim 6, wherein the face plate is generally cylindrical.

9. A bollard assembly comprising the stress control device of claim 6, the bollard assembly comprising a bollard post wherein the stress control device is positioned adjacent to the bollard post.

10. The bollard assembly of claim 9, wherein the bollard post is generally cylindrical and the face plate is arcuate and has a radius of curvature greater than a radius of the bollard post.

11. A method of installing the bollard assembly of claim 1, comprising the steps of:

forming an aperture through a pavement;

digging a hole in a foundation soil below the aperture in the pavement;

positioning the bollard assembly through the aperture in the pavement and into the hole in the foundation soil such that the ground sleeve and a portion of the bollard post are positioned in the hole and the stress control device is positioned within the aperture in the pavement; and pouring a foundation pier around the ground sleeve, the foundation pier filling the hole in the foundation soil and the aperture in the pavement and completely covering the stress control device.

12. The method of claim 11, wherein the plurality of support plates comprise four support plates and the support plates are angularly spaced 90 degrees from each other.

13. The method of claim 11, wherein the ground sleeve is generally cylindrical and the face plate is arcuate and has a radius of curvature greater than a radius of the ground sleeve.

14. The method of claim 13, wherein the face plate is generally cylindrical and substantially surrounds the ground sleeve.

* * * * *